United States Patent [19]

Widén

[11] 4,052,094

[45] Oct. 4, 1977

[54] SANDWICH-TYPE MOTOR VEHICLE DOOR AND FLUSH MOUNTED LOCK CASSETTE

[75] Inventor: Bo Gustaf Widén, Torshalla, Sweden

[73] Assignee: GKN-Stenman AB, Eskilstuna, Sweden

[21] Appl. No.: 648,704

[22] Filed: Jan. 13, 1976

[30] Foreign Application Priority Data

Jan. 17, 1975 Sweden ..... 7500512

[51] Int. Cl.[2] ..... E05C 3/26

[52] U.S. Cl. ..... 292/336.3; 292/337; 292/DIG. 53; 292/216; 292/DIG. 23; 292/DIG. 31

[58] Field of Search ..... 292/337, 336.3, 198, 292/216, 280, DIG. 23, DIG. 31, 113, DIG. 53

[56] References Cited

U.S. PATENT DOCUMENTS

| | | | |
|---|---|---|---|
| 1,300,991 | 4/1919 | Miller | 292/DIG. 23 |
| 1,789,775 | 1/1931 | Russ et al. | 292/216 X |
| 2,600,483 | 6/1952 | Colonna | 292/DIG. 31 |
| 3,409,321 | 11/1968 | Wolfslayer | 292/216 |
| 3,504,511 | 4/1970 | Allen | 292/216 X |
| 3,668,907 | 6/1972 | Pastva, Jr. | 292/DIG. 31 |

*Primary Examiner*—Richard E. Moore

*Attorney, Agent, or Firm*—Sughrue, Rothwell, Mion, Zinn and Macpeak

[57] ABSTRACT

So as to mount a lock mechanism in a vehicle door at least partly of sandwich construction the door in the region of its outer side and end wall is provided with a compartment which from the end wall surface extends into the door and has one adjacent or complementary recessed portion in the outer side wall of the door. The lock mechanism is made in the form of a cassette which comprises at least two main parts, i.e. one lock house part and one adjoining control part. The cassette and the commpartment with the adjoining recessed portion are designed in such a way relative to each other that in the mounted position of the cassette the outside of its lock house part connects to and forms part of the door's outer end wall surface whereas the outside of its control part connects to and forms part of the door's outer side wall surface.

5 Claims, 6 Drawing Figures

SANDWICH-TYPE MOTOR VEHICLE DOOR AND FLUSH MOUNTED LOCK CASSETTE

The doors of motor vehicles have hitherto been constructed of an outer shell and an inner shell both made of sheet metal, the inner shell being provided with so-called door trim. Arranged between the two shells are the different mechanisms associated with the door, such as the door-window raising and lowering gear, the door-window guide structures, the door locking mechanism and the different means for operating said mechanism. The outer handle of the door lock mechanism and the lock barrel are often mounted on the outer shell and caused to co-operate with the lock mechanism in some suitable manner.

German Pat. No. 384,616 and French Pat. Nos. 518,595 and 574,792 describe previously known vehicle doors with appertaining locks and handles.

In order to satisfy current safety requirements with respect to motor vehicles, it is now often the practice to provide an impact-absorbing beam between the inner and outer shells. In this way, loads to which the side of a vehicle is subjected as a result of a side collision can be absorbed in a more advantageous manner than when no such beam is provided.

In recent times attempts have been made to provide a motor vehicle door of sandwich construction, the major portion of the space between the outer and inner shell being filled with an expanding material. This enables the door of a motor vehicle to be readily imparted the rigidity required for an acceptable degree of collision safety. With doors thus constructed, however, problems arise in connection with the mounting of the aforementioned mechanisms associated with the door. Particular difficulties are encountered with the mounting of the door lock mechanism and operating means therefor, these difficulties being mainly caused by the fact that the lock mechanism — as opposed to the remaining mechanisms in the door — shall be capable of being actuated both from the outside and the inside of the door.

Accordingly, an object of the present invention is to eliminate this difficulty with a motor vehicle door of the aforementioned type by providing a novel method of mounting a lock mechanism in the door of a motor vehicle.

A further object of the invention is to provide a novel vehicle door lock mechanism which facilitates the mounting of the mechanism in the door and which provides particular functional advantages in the use of the mechanism.

Accordingly there is provided a method of mounting a lock mechanism in a motor vehicle door, preferably a door of sandwich construction, the method mainly comprising the steps of providing the door in the region of its outer side and end wall with a compartment which from the end wall surface extends into the door and has one adjacent or complementary recessed portion in the outer side wall of the door, constructing the lock mechanism in the form of a cassette which comprises at least two main parts, i.e. one lock house part and one adjoining control part, shaping the cassette and the compartment with the adjoining recessed portion in such a way relative to each other that in the mounted position of the cassette the outside of its lock house part connects to and forms part of the door's outer end wall surface whereas the outside of its control part connects to and forms part of the door's outer side wall surface, and inserting and securing the cassette in the door compartment.

The recess in the door is conveniently formed so that the lock cassette is accessible and/or removable without it being necessary to remove an inner side panel or the like associated with the door.

This simplified method of mounting a lock mechanism in the door of a motor vehicle in accordance with the invention greatly simplifies the manufacture of vehicle doors as well as lock mechanisms and reduces the cost of mounting said lock mechanism in the door and renders the lock mechanism independent of construction tolerances when mounting the same. Furthermore, the method according to the invention of mounting a lock mechanism provides functional advantages since substantially co-operating measurements for, for example, the outer handle of the lock mechanism and the associated lock cylinder are bound within the same unit. Thus, the risk of jamming as a result, for example, of inaccuracies with respect to the fit between co-operating elements is greatly eliminated.

The outer handle of the door may initially be integrated in the lock cassette and the portion of the cassette provided with the handle occupies when the lock cassette is placed correctly in the portion of the recess arranged on the outer surface of said door. The portion of the lock cassette provided with the handle may conveniently be provided with a recess or the like for accommodating the handle in its non-activated position in a manner such that no portions of the handle project beyond the outer face of the door. Preferably, the handle is mounted in the recessed portion in a manner such that, in the event of the vehicle being involved in a side collision no portion of the object with which the vehicle collides can engage the handle and lift it so as to open the door.

In accordance with a preferred embodiment of the invention, the recess which receives the lock cassette is provided with at least one guide surface which is adapted to cooperate with a corresponding surface on the lock cassette, the lock cassette being mounted by pushing said cassette into position in the recess. The cassette can then be secured to the vehicle door by means of screws, for example.

The invention also relates to a lock cassette for vehicle doors having preferably a sandwich construction, with which cassette the aforementioned method can be put into effect. The lock cassette is mainly characterised in that it comprises two main parts, i.e. one lock house part and one control part connected thereto, said cassette having a size and shape which is adapted to fit a compartment in the vehicle door, said compartment having one portion which from the end wall of the door extends into the door and an adjacent or complementary recessed portion in the outer side wall of the door, the outside of the lock house part of the cassette upon mounting of the cassette in the compartment connects to and forms part of the end wall surface of the door whereas the control part of the cassette connects to and forms a part of the outer side wall surface of the door.

Associated with the lock cassette is a handle which either forms part of the cassette or can be mounted thereto at the same time as the cassette is mounted in position, or subsequent thereto. Then handle itself is conveniently arranged to operate with a handle portion, preferably in the form of a recess comprising an integral part of the lock cassette.

According to an embodiment which is preferred in certain instances, the cassette is provided with a lock barrel.

Further, the cassette may be provided with at least one guide surface for co-operation with a corresponding guide surface in the recess. The lock cassette can be readily mounted in the recess by pushing said cassette thereinto until it occupies the required position.

In this respect it is preferred that the guide surface is formed on a part of the cassette, preferably on the part which forms the actual lock housing.

On the inside of the vehicle door there is preferably provided an inner handle which co-operates with the lock mechanism and which actuates said mechanism via an operating link connected to the handle. When the lock cassette is mounted in position, the operating link is caused to engage a corresponding operating means associated with the lock cassette in the intended manner, thereby to permit the lock mechanism to be actuated from within the vehicle.

So that the invention will be more readily understood and further features thereof made apparent, embodiments of the invention will now be described with reference to the accompanying drawings, in which.

Figure 1:
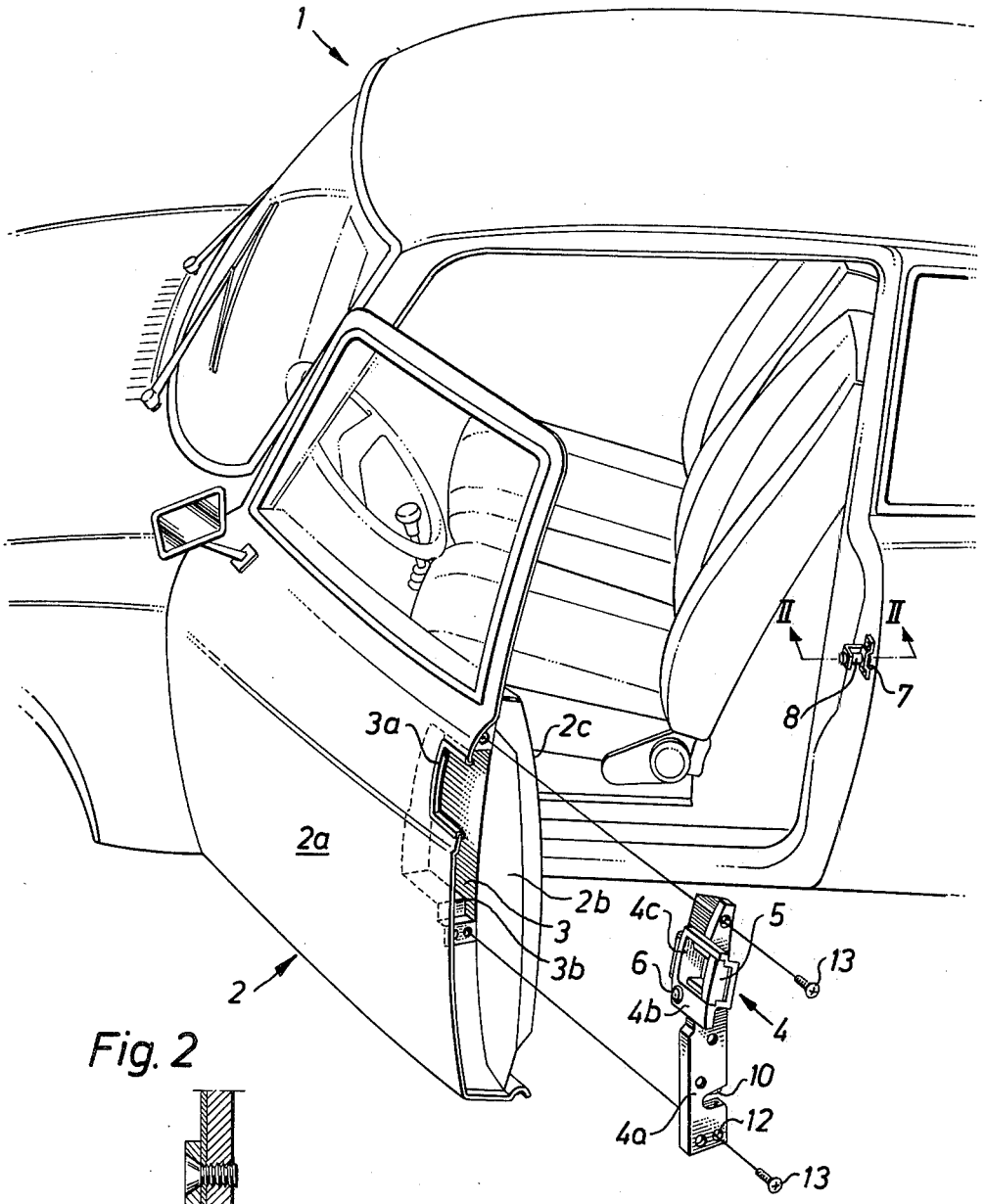
FIG. 1 is a perspective, exploded view of part of a vehicle having a door which is intended to receive a lock cassette according to the invention provided with a handle.
Figure 2:
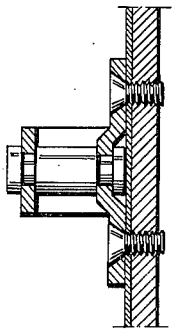
FIG. 2 is a sectional view taken on the line II—II of FIG. 1.
Figure 3:
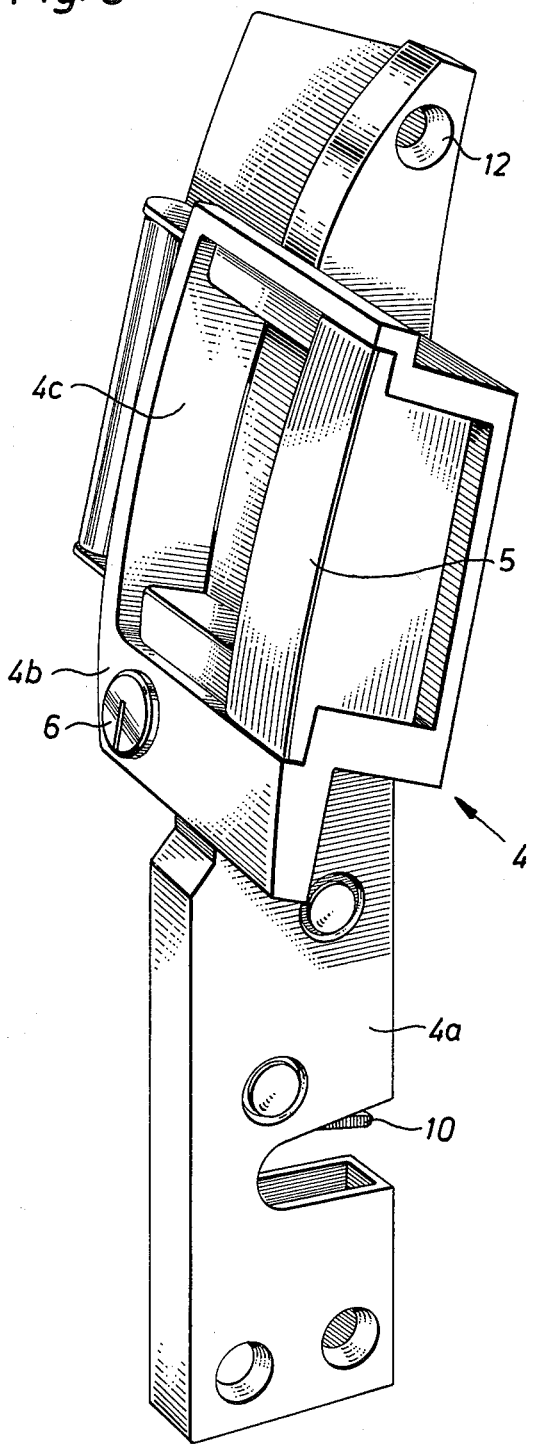
FIG. 3 is a perspective view in larger scale of the lock cassette shown in FIG. 1.
Figure 4:
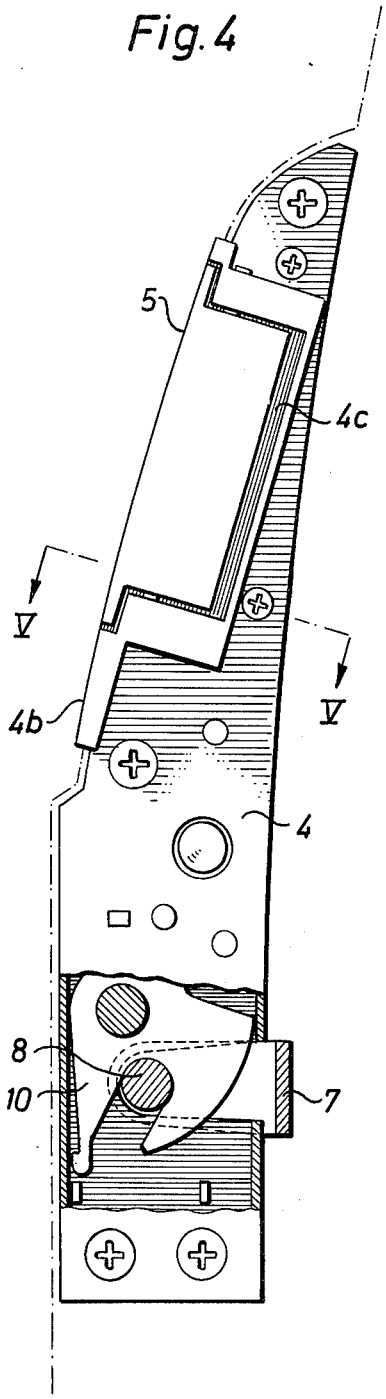
FIG. 4 is a partially cut-away end view of a lock cassette according to the previous Figures.

Referring to FIGS. 1–5, there is shown a motor vehicle 1 provided with a door 2 of sandwich construction. The door has an outer side 2*a*, an end wall 2*b* and an inner side 2*c*. A reinforcing layer is arranged between the outer and inner sides 2*a*, 2*c* of the vehicle door.

A lock mechanism associated with the door is shown generally at 4. The lock mechanism has the form of a cassette comprising two main parts, i.e. a housing 4*a* which accommodates the lock mechanism, and one control or handle part 4*b* having a recessed portion 4*c* in which a handle 5 is movably mounted. Also arranged in the control part 4*b* is a lock cylinder 6 adapted to lock the lock mechanism. The control part 4*b* of the cassette projects beyond the outside of the cassette's housing 4*a* and forms substantially right angles thereto.

To facilitate mounting of the lock mechanism in the vehicle door, the door 2 is provided in the vicinity of the end wall 2*b* thereof with a compartment 3, the shape and size of which is such as to permit the lock cassette 4 to be inserted thereinto. The housing part 4*a* of the lock cassette conveniently forms a supplementary portion of the outer end wall 2*b* of the door and the control part 4*b* a supplementary portion of the outer side surface 2*a* of the door, so that the door is complete and so that said lock cassette conforms to the general contour of the door. For this purpose the compartment 3 has arranged in the outer side thereof a recessed portion 3*a*. This recess is adapted to receive the control or handle part 4*b* of the lock cassette, which handle portion, as before-mentioned, comprises a recess 4*c* in which the handle 5 is accommodated.

The lock cassette is fixed to the door by means of screws 13 which are passed through corresponding holes 12 in the cassette.

The compartment 3 and the cassette 4 are adapted with respect to each other so that the cassette when mounted substantially fits and possibly fills said compartment.

If it is required to repair or to exchange the cassette, the cassette and appertaining lock mechanism are thus accessible from outside the door, without it being necessary to remove the inner side panel 2*c* of the door or any corresponding element.

The compartment 3 is in the embodiment described provided with a lower guide surface 3*b* which is adapted to co-operate with a corresponding surface on the lock cassette — in the illustrated embodiment the portion of the cassette provided with the lock housing 4*a*. This guide surface enables the lock cassette to be pushed in position in the compartment 3 to its correct position.

Arranged in the door-frame of the vehicle is a plate 7 having a bolt 8 which, when the door is closed, is caused to co-act in a conventional manner with a member 10 associated with the lock mechanism so that the door is held in place in a forward lock position.

Figure 5:
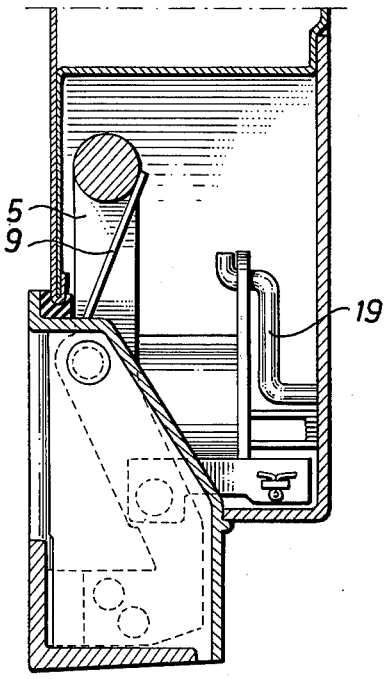
FIG. 5 is a sectional view on the line V—V of FIG. 4.

In FIG. 5 the reference 9 indicates a spring which attempts to move the handle 5 to its starting position in the handle portion 4*b*. A link 19 is arranged to transmit the movement of the handle to the lock mechanism accommodated in the lock housing. The handle can be constructed in many different ways, the lock cassette obtaining a corresponding design. In the embodiments shown in FIGS. 1–5, the outer handle is integrated with the lock cassette. It is possible within the scope of the invention, however, to provide the lock cassette with a separate handle, which is mounted subsequent to the lock cassette having been positioned in the door.

As a rule the lock cylinder is not required with lock cassettes which are intended to be fitted to the passenger doors of vehicles. Locking of the lock mechanisms in this case is effected in a conventional manner, by actuating push-buttons or similar release devices arranged on the inside of the door. Such push-buttons are adapted to actuate the lock mechanism by means of operating links (not shown) suitably arranged in the vehicle door.

Figure 6:
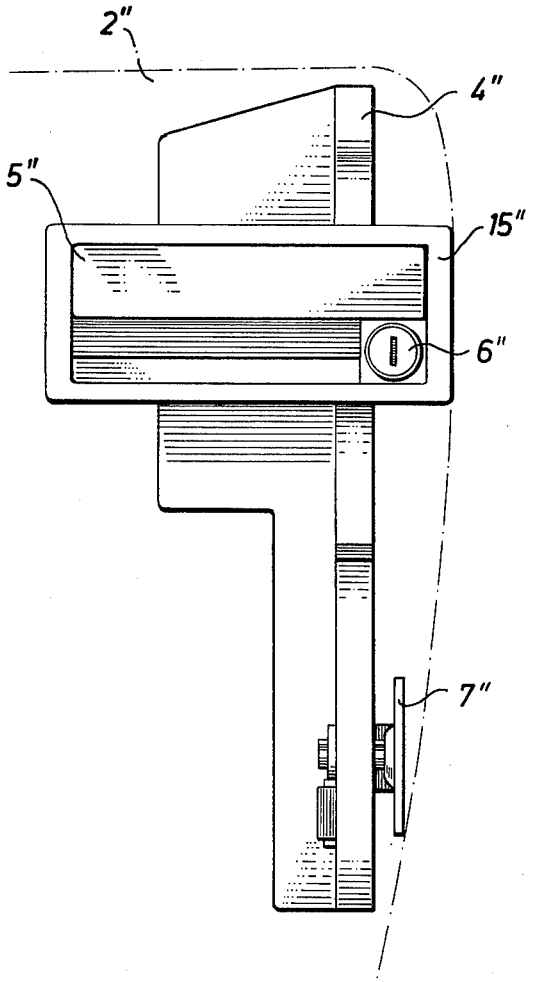
FIG. 6 is a side view of a modification of a lock cassette according to the invention.

FIG. 6 shows an alternative embodiment of lock cassettes according to the invention. It is also intended for mounting from the end wall end of the door 2″. The handle 5″ plus the lock cylinder 6″ together with the respective cassette 4″ are constructed as one unit.

An attachment plate 15″ registers with the outer contours of the door 2″. This plate is provided with a recess having a depth suitable to receive the handle 5″.

It will be understood that the lock cassette can be modified in many ways within the scope of the following claims. In some cases it may for instance be suitable to secure a thin cover plate (not shown) over the outer end face of the lock house part of the cassette. This plate can easily be removed when the lock cassette is to be dismounted for service or repair. Further, the cassette may comprise more than two main parts.

I claim:

1. In combination, an automotive vehicle door of sandwich construction comprising spaced inner and outer sidewalls separated by a reinforcing layer and having an end wall joined at right angles to said sidewalls and extending along one end thereof, said end wall being recessed to form a cassette receiving compartment which extends between said sidewalls, said door outer sidewall being recessed inwardly from its edge adjacent said end wall and opening to said compartment, a cassette comprising a lock house part and a control part connected thereto, said cassette being mounted to said door and within said compartment with said lock house part mounted to said door end wall with its exterior face lying flush therewith, and said control part projecting through said outer sidewall recess opening and lying flush with and forming part of said outer sidewall surface.

2. The combination of claim 1, wherein the control part of said cassette constitutes a projection to one side of the lock house part of the cassette and being formed substantially at right angles thereto.

3. The combination of claim 1, wherein said control part is recessed on its face which lies flush to said door outer sidewall and carries a door handle within said control part recess.

4. The combination of claim 1, further comprising a lock cylinder carried by said control part of said cassette.

5. The combination of claim 1, further comprising interfitting guide surfaces provided within said door compartment and on said cassette to guide said cassette during insertion within said compartment.

* * * * *